US006913439B2

(12) United States Patent
Rutschmann et al.

(10) Patent No.: US 6,913,439 B2
(45) Date of Patent: Jul. 5, 2005

(54) EXHAUST GAS TURBOCHARGER FOR AN INTERNAL-COMBUSTION ENGINE

(75) Inventors: Erwin Rutschmann, Tiefenbronn (DE); Joachim Kelm, Pforzheim (DE); Christoph Pleuss, Weissach (DE); Andreas Musgiller, Zeitz (DE)

(73) Assignee: Dr. Ing. h.c.F. Porsche AG, Weissach (DE)

( * ) Notice: Subject to any disclaimer, the term of this patent is extended or adjusted under 35 U.S.C. 154(b) by 103 days.

(21) Appl. No.: 10/347,631

(22) Filed: Jan. 22, 2003

(65) Prior Publication Data

US 2003/0150212 A1 Aug. 14, 2003

(30) Foreign Application Priority Data

Jan. 22, 2002 (DE) ..... 102 07 456

(51) Int. Cl.[7] ..... F01D 9/06; F02D 23/00
(52) U.S. Cl. ..... 415/115; 415/204; 60/602
(58) Field of Search ..... 60/602; 415/200–205, 415/215.1, 115, 215

(56) References Cited

U.S. PATENT DOCUMENTS 2,944,786 A * 7/1960 Angell et al. ..... 415/205
3,408,046 A * 10/1968 Woollenweber, Jr. ..... 415/205
4,027,994 A * 6/1977 MacInnes ..... 415/205
4,381,171 A * 4/1983 Chapple ..... 415/204
4,473,931 A * 10/1984 Komatsu ..... 415/205
2003/0077170 A1 * 4/2003 Osako et al. ..... 415/204

FOREIGN PATENT DOCUMENTS

| | | | | |
|---|---|---|---|---|
| DE | 28 13 638 | | 11/1978 | ..... F01D/9/06 |
| DE | 36 17 537 A1 | | 11/1987 | ..... F01D/9/06 |
| DE | 37 24 385 C2 | | 2/1989 | ..... F01D/9/06 |
| JP | 59046302 A | * | 3/1984 | ..... 415/125 |
| SU | 566942 | * | 7/1977 | ..... 415/205 |

* cited by examiner

*Primary Examiner*—Thai-Ba Trieu
(74) *Attorney, Agent, or Firm*—Crowell & Moring LLP

(57) ABSTRACT

An exhaust gas turbocharger for an internal-combustion engine has a turbine housing and compressor housing in which a turbine wheel and a compressor impeller are connected with one another shaft. The turbine housing has a spirally-extending inlet duct for the exhaust gases. Devices for the flow deflection can be provided in the inlet duct. As a result, the thermal stress as well as the efficiency of an exhaust gas turbocharger with a spirally extending inlet duct for the exhaust gases are improved.

2 Claims, 2 Drawing Sheets

EXHAUST GAS TURBOCHARGER FOR AN INTERNAL-COMBUSTION ENGINE

BACKGROUND OF THE INVENTION

The present invention relates to an exhaust gas turbocharger for an internal-combustion engine having a turbine housing and compressor housing in which a turbine wheel and a compressor impeller are arranged which are connected with one another by means of a shaft, the turbine housing having a spirally extending inlet duct for the exhaust gases.

DE 37 24 385 C2 discloses a radial-flow turbine for an exhaust gas turbocharger whose inlet duct for the exhaust gases has a spiral construction. As a result of the curved inlet geometry, in comparison to a straight inlet duct aligned tangentially to the turbine housing, a compact overall geometry of the exhaust gas turbocharger can be achieved which meets the restrictive package demands of modern passenger cars. The curved inlet duct geometry has, however, disadvantages with respect to the flow distribution of the exhaust gas entering the turbine. Furthermore, the known geometry leads to an increased flow against the wall in the so-called tongue area. That is, increased flow occurs in the transition area of the inlet duct into the turbine space which results in additional thermal or mechanical stress.

SUMMARY OF THE INVENTION

An object of the present invention is to provide, despite a curved inlet duct for the turbine housing, the same thermodynamic characteristics as those of an exhaust gas turbocharger having a straight inlet duct which is aligned tangentially with respect to the turbine housing. This object has been achieved by providing devices for flow deflection in the inlet duct.

By providing devices for the exhaust gas flow deflection provided in the inlet duct of the turbine housing, the gas flow in the inlet area of the turbine of the exhaust gas turbocharger is positively influenced in that particularly the inflowing exhaust gas is directed toward the duct center. As a result, the flow losses can be minimized, the flow against the turbine wheel blades can be improved and the thermodynamic efficiency of the turbine or of the exhaust gas turbocharger as a whole can be increased. Furthermore, as a result of the flow deflection, the wall sections provided in the tongue area of turbine housing are exposed to less thermal stress.

The flow deflection is achieved in a simple manner by a jump-type or spoiler-type flow deflection projection provided on the interior wall of the spiral-shaped inlet duct. This jump-type or spoiler-type flow deflection projection is advantageously integrated in the interior wall of the spiral-shaped inlet duct and can therefore be produced in a joint manufacturing step together with the turbine housing. For an optimal flow deflection, it is provided to arrange the projection directly in front of the neck cross-section of the spiral-shaped inlet duct.

BRIEF DESCRIPTION OF THE DRAWINGS

These and other objects, features and advantages of the present invention will become more readily apparent from the following detailed description of currently preferred configurations thereof when taken in conjunction with the accompanying drawings wherein.

DETAILED DESCRIPTION OF THE DRAWINGS

Figure 1:
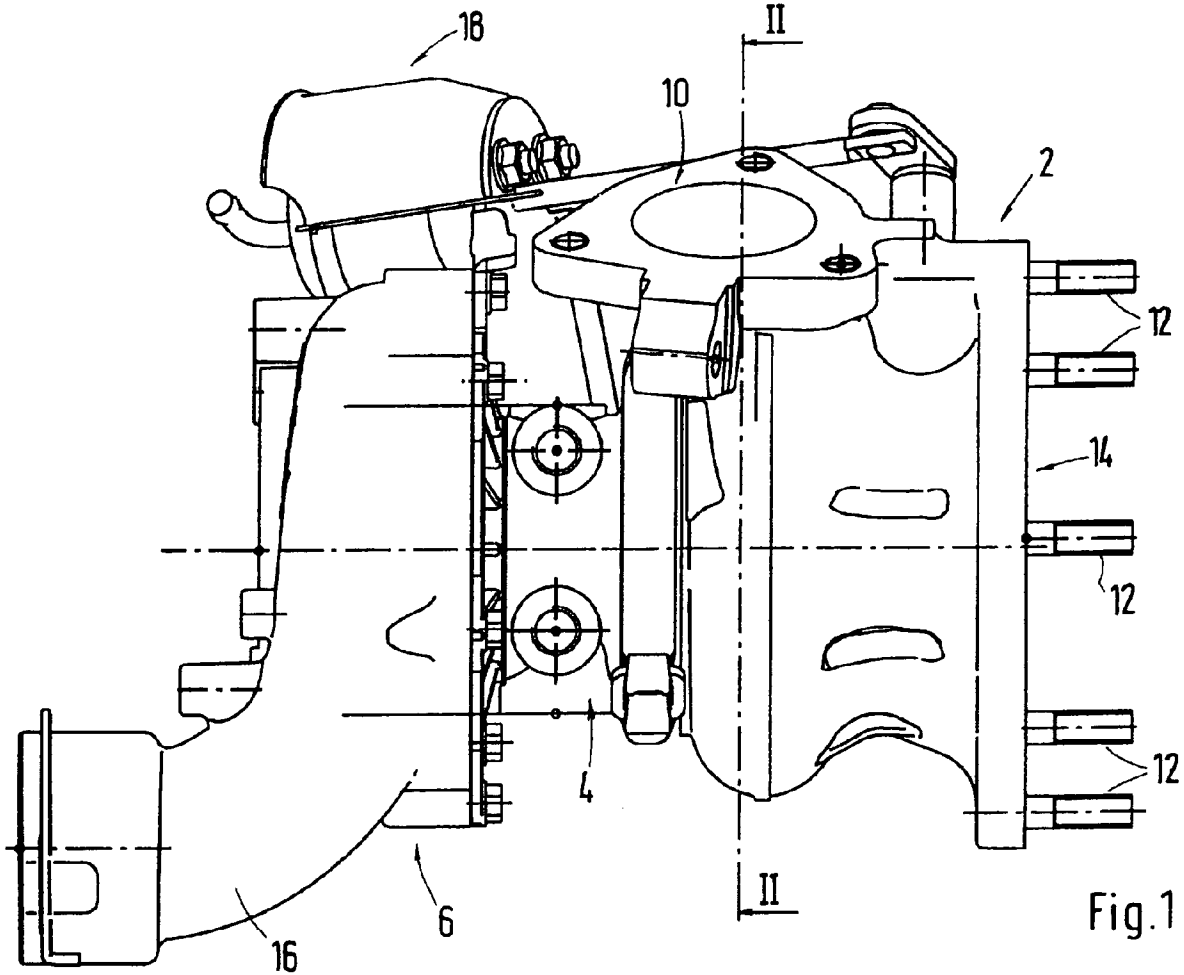
FIG. 1 is a view of an exhaust gas turbocharger for an internal-combustion engine in accordance with the present invention.

The exhaust gas turbocharger consists essentially of a turbine housing 2, a bearing housing 4 and a compressor housing 6. The bearing housing 4 accommodates the rotor runner (not shown) for the turbine wheel 8 arranged in the turbine housing 2 as well as for the compressor impeller (not shown) arranged in the compressor housing 6. By way of a flange 10 provided on the housing of the exhaust gas turbocharger, the exhaust gas turbocharger can be fastened to an exhaust manifold of an internal-combustion engine. Furthermore, an exhaust gas flange 14 provided with a fastening bolt 12 is visible at the exhaust gas turbocharger. The continuing exhaust gas system is fastened on the exhaust gas flange in the installed condition. In addition, an air outlet connection piece 16 is provided at the compressor housing 6, by way of which compressed intake air is fed to the internal-combustion engine. A so-called waste gate receptacle 18 provides control of the charge pressure of the exhaust gas turbocharger.

Figure 2:
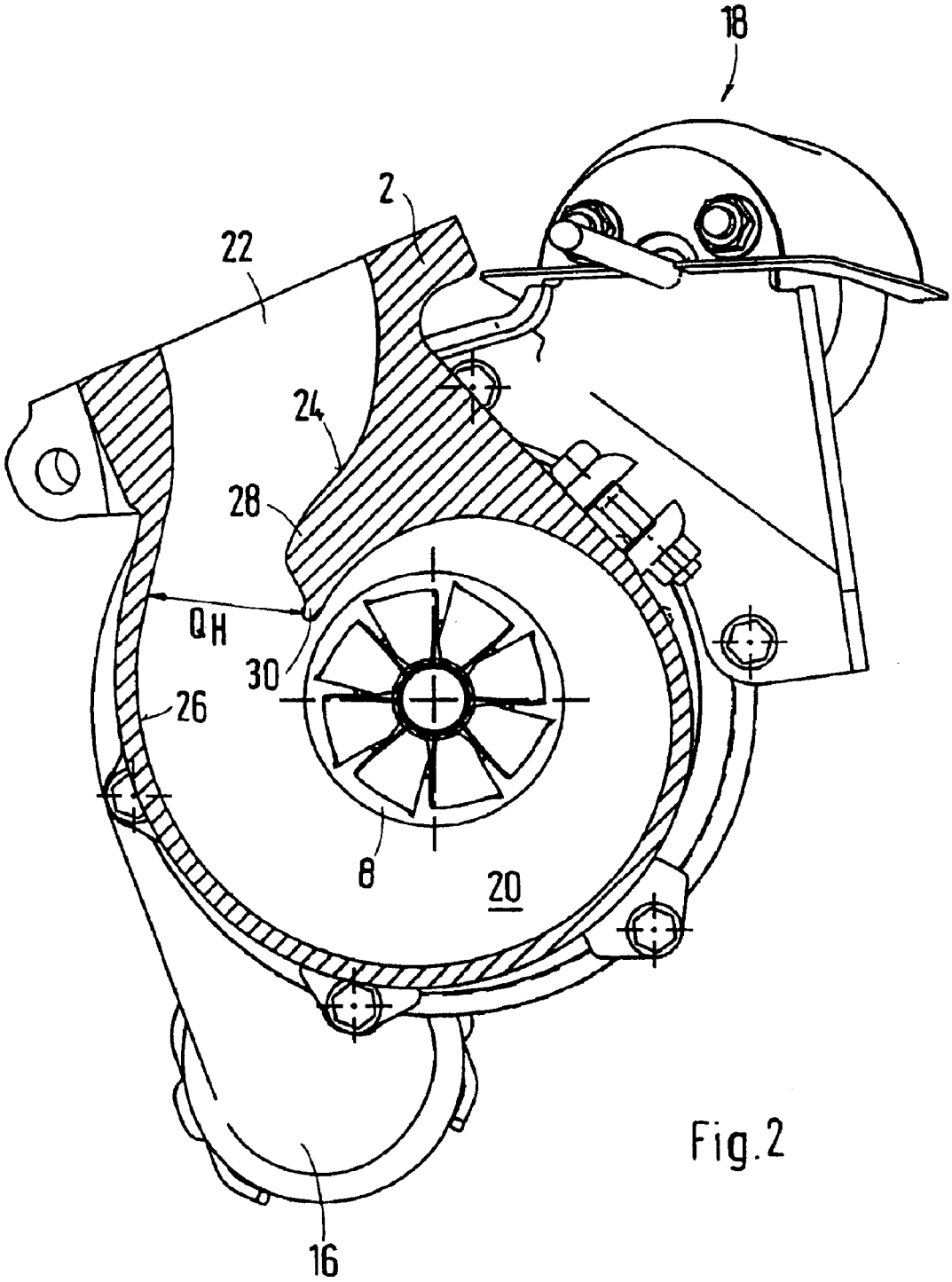
FIG. 2 is a sectional view along line II—II in FIG. 1.

As illustrated in FIG. 2, the inlet duct 22 leading to the turbine space 20 is constructed in a spiral shape. At the transition of the spiral-shaped inlet duct 22 into the turbine space 20, a so-called neck cross-section $Q_H$ is formed between the interior duct wall 24 and the exterior duct wall 26. Before the neck cross-section $Q_H$ is reached, a jump-type or spoiler-type flow deflection projection 28, which projects into the spiral-shaped inlet duct 22, is constructed in the interior duct wall 24. This projection 28, which tapers the duct cross-section, is formed in one piece out of the interior duct wall 24. The jump-type or spoiler-type flow deflection projection 28 deflects or diverts the exhaust gas flow flowing into the spiral-shaped intake duct 22 to the duct center. As a result, the present invention achieves assuring that the exhaust gas flow in the neck cross-section $Q_H$ is not adjacent to the interior duct wall 24, irrespective of the spiral-shaped inlet duct 22. Flow losses can thereby be minimized; the flow against the turbine wheel blades can be improved; and the thermodynamic efficiency of the exhaust gas turbocharger as a whole can be increased. The vertex area of the interior duct wall 24 and the turbine space 20, called the tongue 30, thereby is also subjected to a lower thermal stress.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

We claim:

1. An exhaust gas turbocharger for an internal-combustion engine, comprising a turbine housing, a compressor housing, a turbine wheel operatively arranged in the turbine housing, and a compressor impeller operatively arranged in the compressor housing and operatively connected with the turbine wheel by a shaft, the turbine housing having a spiral-shaped inlet duct for the exhaust gases, wherein a jump-type flow-deflection projection is integrated in an interior wall of the spiral-shaped inlet duct to extend into the spiral-shaped inlet duct to effect flow deflection.

2. The exhaust gas turbocharger according to claim 1, wherein the jump-type flow-deflection projection is arranged directly in front of a neck cross-section of the spiral-shaped inlet duct.

* * * * *